United States Patent [19]

Gross

[11] 3,965,996

[45] June 29, 1976

[54] MEANS AND METHOD OF DRILLING WELLS

[76] Inventor: Bernard K. Gross, 4154 Beachmeadow Lane, Westlake Village, Calif. 91361

[22] Filed: Mar. 20, 1975

[21] Appl. No.: 560,483

[52] U.S. Cl. ..... 175/57; 175/171; 175/260

[51] Int. Cl.[2] ..... E21B 9/26

[58] Field of Search ..... 175/57, 171, 257–261, 175/238

[56] References Cited

UNITED STATES PATENTS

| | | | |
|---|---|---|---|
| 1,454,984 | 5/1923 | Stewart | 175/260 |
| 1,819,798 | 8/1931 | Stokes | 175/261 |
| 1,894,039 | 1/1933 | Hill | 175/171 |
| 2,133,564 | 10/1938 | Patton | 175/104 |
| 2,330,083 | 9/1943 | Sewell | 175/258 |
| 2,641,444 | 6/1953 | Moon | 175/57 X |
| 3,164,215 | 1/1965 | Johnson | 175/261 |
| 3,369,618 | 2/1968 | Moore | 175/171 X |
| 3,552,509 | 1/1971 | Brown | 175/258 |
| 3,880,247 | 4/1975 | Harding | 175/260 |

*Primary Examiner*—Frank L. Abbott
*Assistant Examiner*—Richard E. Favreau
*Attorney, Agent, or Firm*—Lyon & Lyon

[57] ABSTRACT

A means and method of drilling wells wherein the casing and tubing string are rotated with minimum interruption and are moved downwardly simultaneously. A bit assembly, capable of cutting a bore larger than the casing, is lowered and raised through the drill string, the bit assembly being pivotable between a position in which the transverse axis is in alignment with the drill string bore for movement therein and a drilling position in which its longitudinal axis is transverse to the axis of the drill string and surrounding casing and extends radially beyond the casing for drilling operation; the lower end of the drill string and bit assembly having interlocking parts to transmit rotational force from the drill string to the bit assembly.

12 Claims, 14 Drawing Figures

MEANS AND METHOD OF DRILLING WELLS

BACKGROUND OF THE INVENTION

In the drilling of well bores, the standard practice is to mount the cutting bit at the lower end of a drill string; then, when the bit needs replacement to remove the drill string. This is time consuming and expensive particularly in the drilling of deep holes. Also it requires extensive drilling in open hole. Expansive bits have been developed to undercut the area underlying the well casing; however, this has had limited application particularly in deep wells as the casing remains fixed and becomes locked in place. Also, to replace such bits the drill string must be removed. In addition, attempts have been made to provide expansive bits which can be lowered and removed by wireline through the bore of the drill string itself. Insofar as known, this type of expansive bit has not proven satisfactory.

SUMMARY OF THE INVENTION

The present invention is directed to means and method of drilling wells which overcomes the problems heretofore encountered and is summarized in the following objects:

First, to provide a means and method of drilling wells which includes a novelly arranged bit assembly of simple construction having a drilling diameter exceeding the casing diameter, but having a cross section of less diameter than the bore of the drill string, and having a pivoting means whereby the bit assembly may be manipulated between a drilling position and a position in alignment with the drill string bore for movement therein by wireline.

Second, to provide a means and method of drilling wells utilizing the aforementioned laterally extensible bit assembly, wherein both the drill string and casing may be rotated essentially continuously with minimal interruption for addition of drill string and casing sections.

Third, to provide a well drilling means wherein the drill string is provided at its lower end with diametrically disposed essentially semicircular recesses approximating the internal diameter of the drill string, and a bit assembly includes a body structure supporting a set of drilling bits, and dimensioned for reception in the recesses to form a driving connection therewith, the body structure being attached to a wire line manipulated sleeve slidable within the drill string, there being interconnecting elements which serve to effect pivotal movement of the body structure between a drilling position and a position for movement within the drill string.

DESCRIPTION OF THE FIGURES

Referring to FIG. 1 which illustrates diagramatically a well head structure forming a part of the means and method of drilling wells. The well head structure includes a foundation 1 supporting vertical guide members 2 and provided with a slip assembly 3 for supporting and rotating a casing 4.

Figures 1, 2, 3, 4:
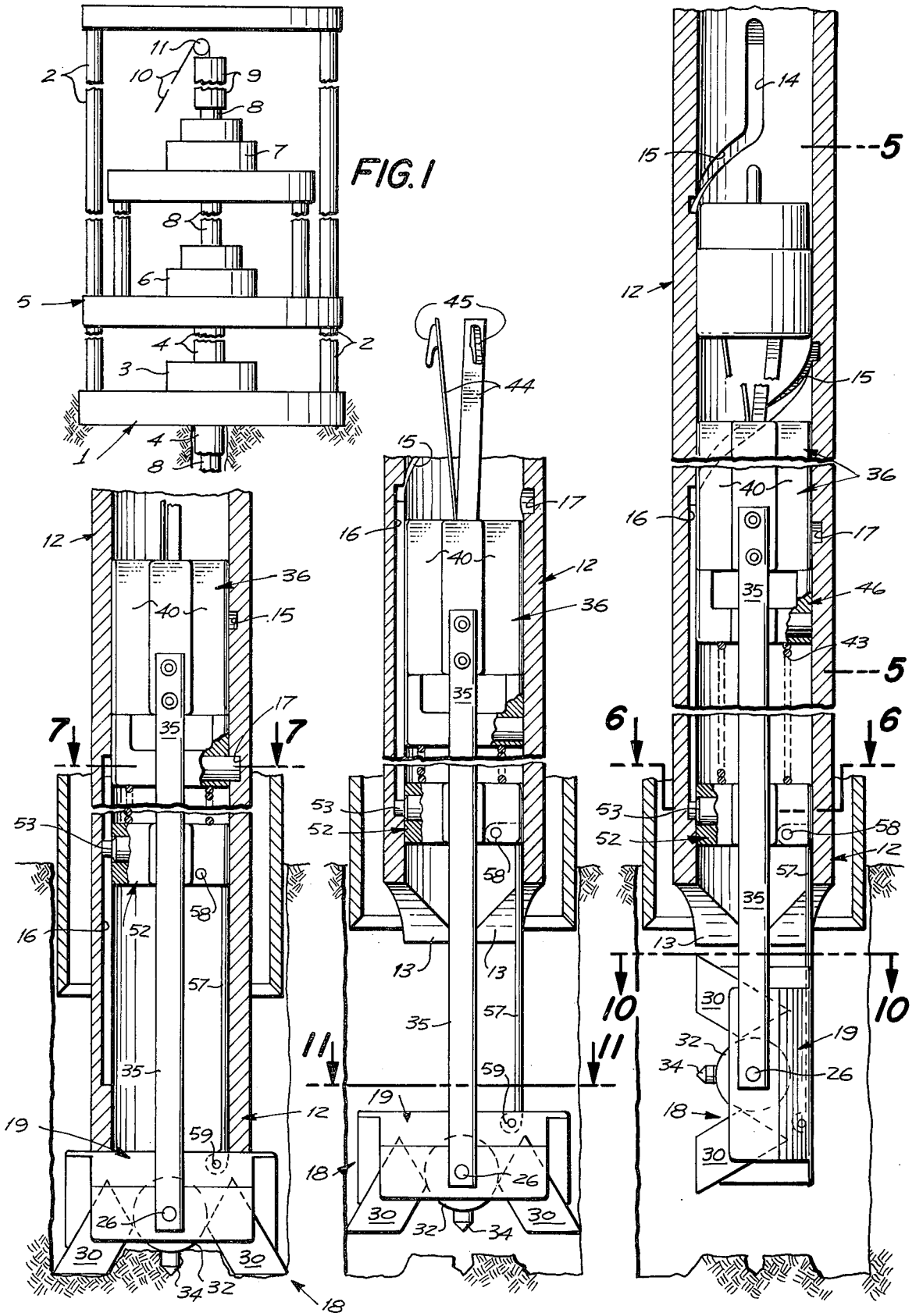
FIG. 1 is a diagramatical view of a well head utilized in conjunction with the means and method of drilling wells.
FIG. 2 is a fragmentary longitudinal sectional view, showing the well drilling means, with the bit assembly as it appears aligned with the drill receiving sleeve disposed at the lower end of a drill string.
FIG. 3 is a similar fragmentary longitudinal sectional view, showing the bit assembly in its transverse position prior to operation.
FIG. 4 is a similar fragmentary longitudinal sectional view, showing the bit assembly in its drilling position.
Figure 8:
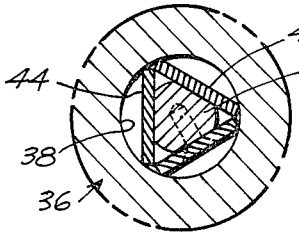
FIG. 8 is an enlarged fragmentary transverse sectional view taken through 8—8 of FIG. 5.

The guide members 2 support an elevator 5 which carries a casing rotary table 6 and supports a drill string rotary table 7 which in turn supports a drill string 8 and a drill assembly recovery chamber 9 which receives a wireline 10 guided by a pulley 11.

The lower end of the drill string 8 is attached to a drill sleeve 12 by a conventional fitting not shown. The lower end of the drill sleeve 12 is provided with a pair of diametrically disposed semicircular recesses 13 forming a horizontal drive channel. The upper portion of the drill sleeve 12 is provided internally with an upper axially directed slot 14 joined to a helical orienting slot 15 the lower end of which is joined to a lower axially extending slot 16. The drill sleeve 12 is also provided intermediate its ends with a latch socket 17.

The drill string 8 and the sleeve 12 slidably receive a bit assembly 18, shown in FIGS. 1–3, and 10–14. The bit assembly includes a body structure 19 having a semicylindrical side 20, the opposite side being recessed to form a confronting angularly related end walls 21 each having a journal stud 22. The recess also forms a pair of opposed fixed sidewalls 23, one of which is provided with a removable sidewall portion 24. The confronting surfaces of the sidewalls are angularly related and are provided with journal studs 25.

Centered with respect to the ends of the body structure and disposed at diametrically opposite sides thereof, is a pair of pivot lugs 26. The semicyindrical side 20 of the body structure is provided with a longitudinally extending link receiving recess 27 at one end of which is a link receiving socket 28 offset axially from the pivot lugs 26.

The semicylindrical side 20 of the body structure is intersected by a plurality of drilling fluid passages 29, which are directed into the recessed side of the body structure.

The journal studs 22 extending from the end wall 21 receive a pair of main bits 30. To simplify the illustration, the bits are shown diagramatically; that is in the form of rotary cone frustums, however it is to be understood that the bits 30 are provided with conventional drilling teeth. The bits may be retained in place by split retainer rings 31. In this connection, it should be noted that when in operation, the forces applied to the bits 30 are in a direction to force the bits on to the journal studs 22, so that the retainer rings 31 need serve only to hold the main bits in place when not in operation. Appropriate thrust washers are provided between the main bits and the walls 21.

A pair of secondary bits 32 are mounted on the journal stud 25. The secondary bits are also shown diagramatically but are provided with conventional cutting teeth. The secondary bits are centrally conical and their apex ends are in continuous relation hence the need to mount one of the bits 32 on the removable sidewall portion 24. Because of the close relation between the apex ends of the bits 32, these ends may be mutually engageable to prevent slippage from their respective journal studs 25. When in operation the forces on the secondary bits are such as to maintain the bits separated.

A U-shaped frame 33 is secured in the recessed side of the body structure 19 in centered relation between the main bits 30 and secondary bits 32, and supports a central fixed spear bit 34.

The pivot lugs 26 journal a pair of connecting bars 35 which pivotly connect the body structure 19 to a body member 36, shown in FIGS. 1–3, 5 and 6. The body member is provided with a bore 37 joined to an upper counter bore 38 and a lower counter bore 39. The body member 36 is provided with external fluid passage channels 40.

The bore 37 of the body member 36 receives a suspension shaft 41 provided with a nut 42 and spring 43, the spring extending into the lower counter bore 39. Secured to the shaft 41, are three suspension strips 44 arranged in 120° relationship. The suspension strips are formed of spring material and diverge upwardly and outwardly. Their extremities are provided with radially outwardly disposed fingers 45 which project downward.

Depending from the body member 36, is a U-shaped frame 46, positioned between the connecting bars 35. The cross portion of the U-framed 46 extends diametrically, and is provided with a bore which receives a latch bolt 47 having a cam slot 48 in alignment with the suspension shaft 41. A spring 49 urges the bore 47 diametrically towards the inner surface of the drill receiving sleeve 12. The suspension shaft 41 is provided with an extension strip 50 having a beveled cam surface 51 arranged to hold the latch bolt 47 in its retracted position when the cam surface is raised and permit diametrical movement when the cam surface is lowered, as indicated respectively by solid and dotted lines in FIG. 5.

Disposed under the body member 36 is a slide block 52 having a diametrically extending bore which receives an orienting pin 53 urged outwardly by a spring 54. The slide block 52 is provided with a pair of diametrically disposed guide channels 55, which receive the connecting bars 35. The slide block 52 is also provided with outwardly facing fluid passage channels 56.

A link 57 extends between the slide block 52 and the body structure 19. An upper pivot pin 58 connects the link 57 to the block 52. The lower end of the link 57 is received in the socket 28 and is connected to the body structure 19 by a lower pivot pin 59.

Above the body member 36, there is provided a wireline suspension fitting 60, having a socket 61 in its under side. Secured to the fitting 60, is a downwardly extending sleeve 62, having an inturned angular flange 63 for engagement with the fingers 45 of the suspension strips 44. The fitting 60 is joined to an upwardly extending suspension rod 64 which may be arranged to carry one or more weights 65. The sleeve 62 is interchangeable with a second sleeve 66, the lower end of which is reduced in diameter but also provided with inturned angular flange 67.

Figure 5:
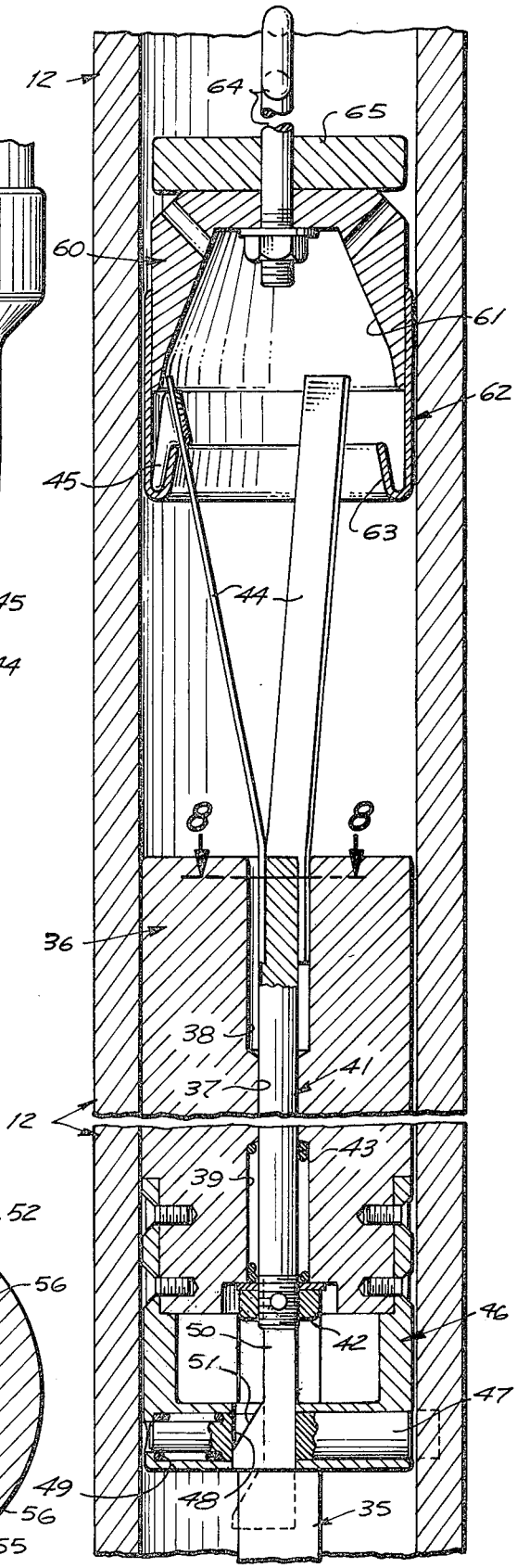
FIG. 5 is an enlarged fragmentary longitudinal sectional view, taken between the lines 5—5 of FIG. 2.
Figure 11:
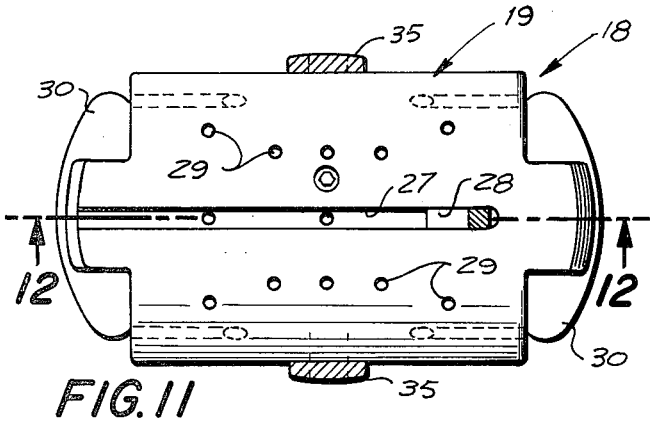
FIG. 11 is an enlarged transverse sectional view taken through 11—11 of FIG. 3 with the bit assembly shown in plan aspect.
Figure 10:
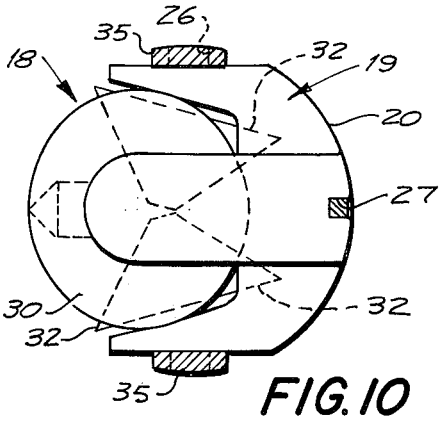
FIG. 10 is an enlarged transverse sectional view taken through 10—10 of FIG. 2 showing the bit assembly in end aspect.
Figure 12:
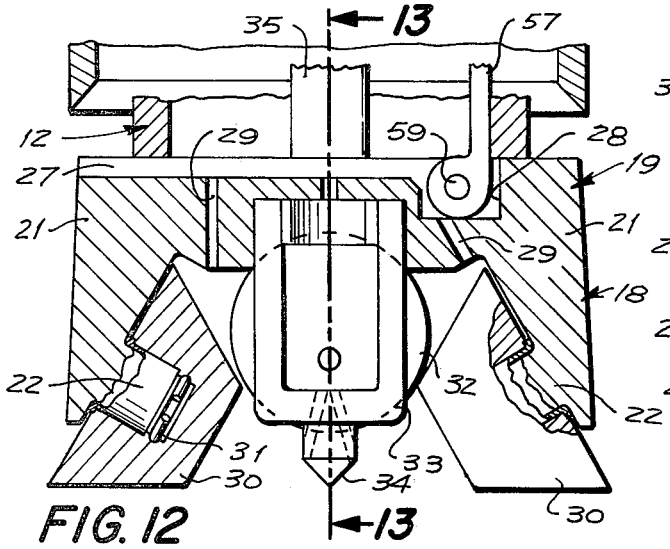
FIG. 12 is a sectional view taken through 12—12 of FIG. 11.
Figure 13:
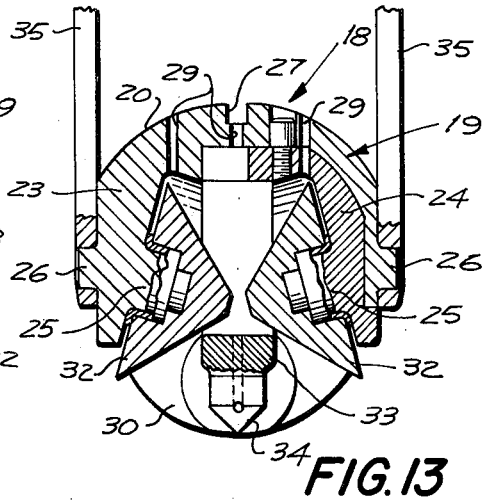
FIG. 13 is a sectional view taken through 13—13 of FIG. 12.
Figure 14:
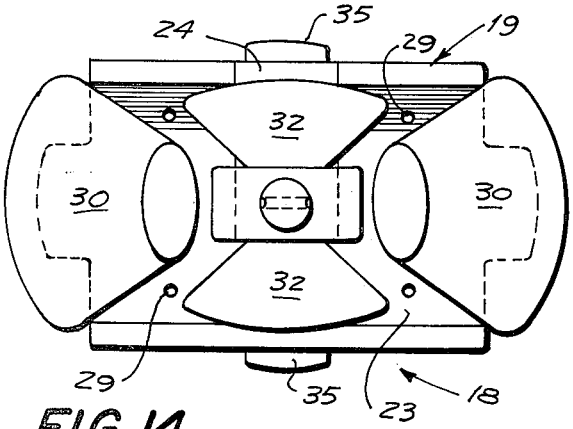
FIG. 14 is a bottom view of the bit assembly.

Operation of the well drilling means is as follows:

Referring particularly to FIG. 2, 3, 4 and 5, during movement through the tubing string the various components of the bit assembly 18 are disposed in axial alignment as shown in FIG. 2 and FIG. 5, and are supported from the fingers 45, in the internal annular flange 63. The orienting pin 53 rides in yieldable contact with the internal surface of the drill string, and the drill sleeve 12. As the slide block 52 is moved downwardly past the helical orienting slot 15, the orienting pin 53 is received therein causing the orienting pin 53 to turn the slide block 52, which turns the connecting bars 35 and the bit assembly 18, into position for later engagement of the body structure 19 with the drive channel 14.

Downward movement is continued until the pin 53 engages the lower end of the slot 16. When the pin reaches the lower end of the slot 16, the bit assembly 18 is protruding axially from the sleeve 12 as shown in FIG. 2. By reason of the fact that the bit assembly 18 is tied to the slide block 52 by the link 57, continued downward movement of the body member 36, causes the bit assembly 18 to pivot from the position shown in FIG. 2 to the transverse position shown in FIG. 3. The drill string 8 and drill sleeve 12 are lowered until the bit assembly 18 contacts the bottom of the well bore. Movement is continued until drive channels 13 receive the body structure 19 as shown in FIG. 4.

As the drill assembly 18 is rotated from the position shown in FIG. 2, to the position shown in FIG. 3, the body member 36 moves downwardly with respect to the slide block 52 also the weight of fitting 60, including the weight member 65, causes the upper ends of the strips 44 to move radially inward by engagement with the sides of the socket 61, and also causing the shaft 41 to move downward against the action of the spring 43 so as to retain the upper ends of the strips 44 in a radially inward position clear of the inturned flange 63, thereby permitting the wireline suspension fitting 60 to be raised. This movement also causes the extension strip 50 and cam surface 51 to move from the solid line to the dotted line position shown in FIG. 5, so that the latch bolt 47 is urged against the inner wall of the sleeve 12. This is the condition of the latch bolt 47 indicated in FIG. 3. Upon subsequent movement of the drill driving sleeve 12 into engagement with the body structure 19, the latch bolt 47 is received in the latch socket 17, as shown in FIG. 4.

Figure 9:
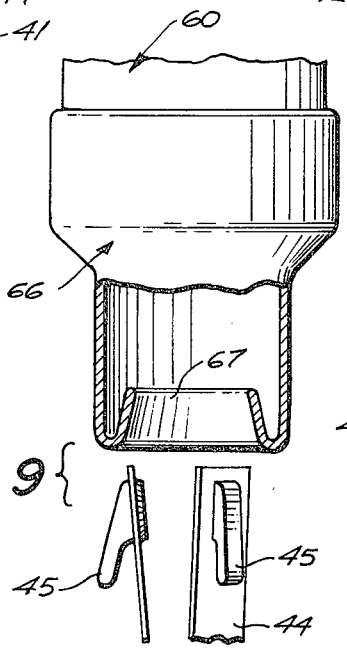
FIG. 9 is a fragmentary view partially in section, illustrating the manner in which the drilling means is connected to a wire line tool for withdrawal.
Figure 7:
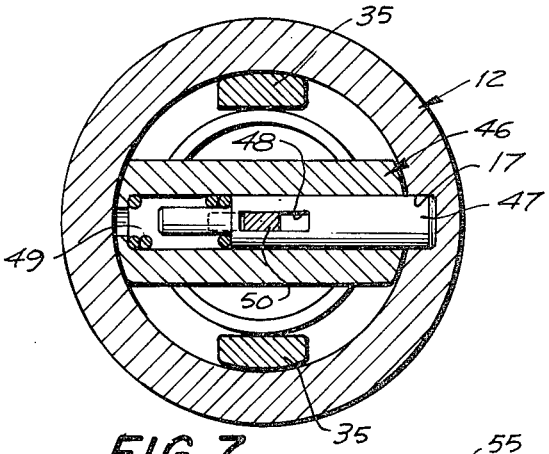
FIG. 7 is an enlarged transverse sectional view taken through 7—7 of FIG. 4.
Figure 6:
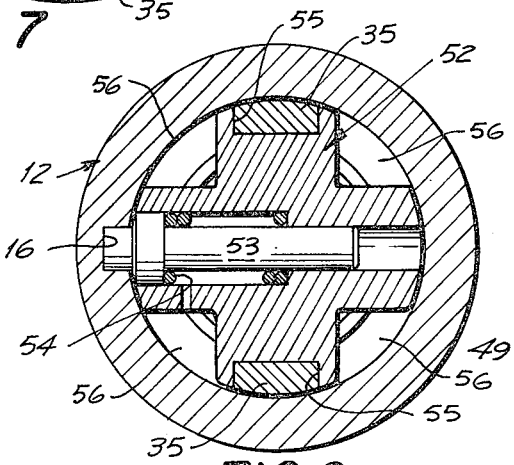
FIG. 6 is an enlarged transverse sectional view taken through 6—6 of FIG. 2.

When it is desired to remove the bit assembly 18 the second sleeve 66 and its internal annular flange 67 of reduced diameter is substituted so as to receive the upper ends of the suspension strips 44 and the finger 45, as indicated in FIG. 9. Once engaged upward force exerted by the wireline suspension fitting 60 draws the shaft 41 upwardly, causing the cam surface 51 to draw the latch bolt 47 inwardly, so as to release the body member 36 for upward movement.

Prior to raising the body member 36, the bit assembly 18 is raised clear of the bottom of the well bore to permit pivotal movement, and the body member 36 is then lowered so that the drill assembly is again in the position shown in FIG. 3. In order to move the bit assembly 18 from the position shown in FIG. 3 to the position shown in FIG. 2, a downward force is maintained on the slide block 52. This may be accomplished by making the slide block of sufficient axial length to have the required weight, or a spring 43 may be interposed between the slide block 52 and body 36, or both weight and spring force may be used.

With the slide block 52 maintained in place, the link 57 and axis of the pin 59 are fixed so that upward movement of the wireline lifts the body member 36 and bars 35 thereby to pivot the bit assembly 18 from the position shown in FIG. 3 to the position shown in FIG. 2 for withdrawal through the sleeve 12 and drill string 8. In order to free the orienting pin 53, the upper vertical position 14 of the orienting channel merges into the contour of the sleeve 12 to force the pin 53 radially inward.

During the bit assembly retracting operation, the drill string may be rotating continuously or may be stopped momentarily. Due to the fact that the distance from the left main bit 30 to the axis of the pins 26 is slightly greater than the radius of the bore cut by the drill assembly the left main bit may contact the surface of the well bore. The axial lengths of the bars 35 are sufficient to permit the drill assembly to deflect. Furthermore the drill string is suspended sufficiently free in the casing to permit the slight deflection required.

The method of drilling wells made possible by the retrievable drill assembly is as follows:

The casing 4 and drill string 8 are rotated essentially continuously, rotation only being stopped for addition of casing sections, and drill pipe sections requiring only a few moments of time. Such continuous rotation minimizes any gravity compaction of solids which increase friction between the casing and well bore and to a lesser extent between the drill string and casing. Also, as the casing 4 and drill string are carried by the elevator 5, the casing and drill string are advanced simultaneously in order to minimize the extent of exposed well bore.

As a result, the depth to which a well casing may extend before friction prevents further rotation and axial movement is materially increased. Likewise the depth to which the corresponding drill string may extend is materially increased. Thus, the total depth to which a well having a given number of casings may be drilled is correspondingly increased.

Having fully described my invention it is to be understood that I am not to be limited to the details herein set forth, but that my invention is of the full scope of the appended claims.

I claim:

1. A means for drilling wells utilizing a drill string and comprising:

a. a body structure having a set of drill bits, the body structure including the drill bits being dimensioned transversely for sliding fit within the drill string and dimensioned longitudinally in excess of the external diameter of the drill string;

b. a wireline suspended means supporting the body structure for sliding movement in the drill string;

c. a sleeve extending from the drill string, and including interlocking means at its lower extremity to secure the body structure in a transversely disposed position and form therewith a drive connection;

d. linkage means joining the sleeve and body structure for effecting movement of the body structure between its position longitudinally of the sleeve and drill string for movement therein and a position transverse to the sleeve for engagement with the inerlocking means and drilling movement upon rotation of the drill string and sleeve;

e. the sleeve including an internal latching socket and an internal channel having a helical intermediate portion and an axial and upper and lower portion;

f. the linkage means including a radial orienting pin for reception in the channel to orient the body structure with respect to the interlocking means;

g. and a latching bolt engageable with the latching socket when the body structure is in engagement with the interlocking means.

2. A means for drilling a well as defined in claim 1 wherein the well is provided with a casing:

a. the longitudinal dimension of the body structure including the bits being dimensioned to form a bore in excess of the diameter of the casing.

3. A means for drilling wells as defined in claim 2, wherein:

a. both the casing and drill string include means for rotation and means for advancing both tubing string and casing during drilling.

4. A means for drilling wells containing a casing and a drill string, the drilling means comprising:

a. a sleeve secured to the lower end of a drill string and having a bore corresponding to the bore of the drill string, the lower extremity of the sleeve having a pair of diametrically disposed driving channels;

b. a bit assembly including a body structure and a set of drill bits, the assembly being of essentially cylindrical configuration and dimensional to fit slidably within the sleeve, the assembly being of greater length than the diameter of the casing and adapted to be received in the driving channels, the drill bits, when the assembly is so disposed, being arranged to cut a circular area greater than the external diameter of the casing;

c. wireline operated means including releasable latch means for moving the bit assembly through the drill string when disposed axially therein;

d. bit assembly pivoting means interposed between the wireline operated means and the bit assembly and operable during movement of the bit assembly beyond the sleeve for moving the bit assembly from a position in axial alignment with the sleeve to a position transverse thereto;

e. and orienting means having interengaging elements incorporated in the sleeve and bit assembly pivoting means operable to orient the bit assembly with respect to the driving means.

5. A means for drilling wells, as defined in claim 4, wherein:

a. means are provided for reconnecting the wireline operating means to the bit assembly pivoting means for raising the bit assembly, the bit assembly pivoting means being operable as the bit assembly is raised from an extended position to move the bit assembly from its transverse position to position axially aligned with the sleeve for entrance therein and subsequent movement upwardly through the sleeve and drill string.

6. A means for drilling wells, as defined in claim 4, wherein:

a. the central portion of the drill body structure when the drill assembly is received in the driving channels, essentially closing the bore of the sleeve, said central portion having a plurality of passageways directed toward the members of the set of drill bits for discharge of well drilling fluid from the drill string against the drill bits.

7. A means for drilling wells, as defined in claim 4, which further comprises:

a. means for effecting essentially continuous rotation of the drill string while advancing the drill string as permitted by the bit assembly;

b. means for effecting essentially continuous rotation of the casing while advancing the casing as permitted by the bit assembly.

8. A method of drilling wells containing a casing and a drill string, characterized by:

a. continuously rotating the casing and drill string except during placement of added sections of casing and drill string;

b. periodically introducing by wireline a bit assembly having a diameter for reception in the drill string and a length greater than the diameter of the well casing;

c. passing the bit assembly through and beyond the drill string and casing;

d. pivoting the bit assembly to a transverse position;

e. securing the bit assembly to the lower end of the drill string for rotation therewith;

f. drilling the formation ahead of the bit assembly;

g. advancing both the drill string and casing as permitted by the bit assembly;

h. periodically disengaging the bit assembly as required by wear of the bit assembly;

i. pivoting the bit assembly into alignment with the bore of the drill string;

j. and retrieving the bit assembly.

9. Means for drilling wells utilizing a drill string and a wireline suspended attachment means, the drilling means comprising:

a. a bit assembly including a body structure and a set of drill bits, the bit assembly being dimensioned longitudinally for sliding movement within the drill string and dimensioned longitudinally in excess of the external diameter of the tubing string;

b. a sleeve continuing from the tubing string for receiving the bit assembly and including interlocking means at its lower extremity to secure the body structure in a transversely disposed position and form therwith a drive connection;

c. suspension means for the bit assembly adapted for removable connection to the wireline suspended attachment means, the suspension means including a first and a second support capable of relative axial movement, a pair of arms depending from the first support and pivotally connected to the body structure at its central transverse axis, and a link depending from the second support and in offset position relative to the arms and also pivotally connected to the body structure;

d. the suspension means being operative on relative movement of the first and second supports when the bit assembly is beyond the sleeve to tilt the bit assembly between a longitudinally disposed position and a transversely disposed position;

e. and means operable as the bit assembly moves through the sleeve to turn the body structure into registery with the interlocking drive means, and engagement therewith upon subsequent retraction.

10. A means for drilling wells, as defined in claim 9, wherein:

a. means is provided for latching the body structure in registery with the interlocking drive means;

b. and wireline operated means is provided to release the latch means to permit relative movement of the arms and link thereby to return the bit assembly to its longitudinal position for retraction.

11. A means for drilling wells, as defined in claim 9, wherein:

a. the body structure and drive means when in mutual engagement, essentially closing the bore of the sleeve, the body structure having passageways directed toward the set of drill bits for discharge of drilling fluid against the drill bits.

12. A means of drilling wells containing a casing and a drill string and utilizing a wireline tool, said means comprising:

a. means for continuously rotating the casing and drill string except during placement of added sections of casing and drill string;

b. a bit assembly having a diameter for reception in the drill string and a length greater than the diameter of the well casing adapted to be introduced and retrieved by the wireline tool, said bit assembly being movable through and beyond the drill string and casing;

c. means for pivoting the bit assembly when beyond the drill string and casing to a transverse position;

d. cooperating means connected to the bit assembly and tubing string for orienting the bit assembly with respect to the drill string;

e. means for securing the bit assembly in its oriented position to the lower end of the drill string for rotation therewith thereby to drill the formation ahead of the bit assembly;

f. and means for advancing both the drill string and casing as permitted by the bit assembly.

* * * * *